US007976294B2

(12) United States Patent
Yanagisawa

(10) Patent No.: US 7,976,294 B2
(45) Date of Patent: Jul. 12, 2011

(54) SCROLL FLUID MACHINE HAVING STATIONARY AND ORBITING SCROLLS HAVING A COUPLING MECHANISM TO ALLOW THE ORBITING SCROLL TO ORBIT RELATIVE TO THE SECOND SCROLL

(75) Inventor: Ken Yanagisawa, Yokohama (JP)

(73) Assignee: Anest Iwata Corporation (JP)

( * ) Notice: Subject to any disclaimer, the term of this patent is extended or adjusted under 35 U.S.C. 154(b) by 576 days.

(21) Appl. No.: 12/058,878

(22) Filed: Mar. 31, 2008

(65) Prior Publication Data

US 2008/0240956 A1 Oct. 2, 2008

(30) Foreign Application Priority Data

Mar. 30, 2007 (JP) ..... 2007-095579

(51) Int. Cl.
*F03C 4/00* (2006.01)
*F04C 18/00* (2006.01)

(52) U.S. Cl. ..... 418/55.3; 418/55.1; 418/60; 418/188; 464/102; 464/104

(58) Field of Classification Search ..... 418/55.1–55.6, 418/57, 60, 188; 464/102, 104
See application file for complete search history.

(56) References Cited

U.S. PATENT DOCUMENTS 5,149,255 A * 9/1992 Young ..... 418/55.3
5,320,506 A * 6/1994 Fogt ..... 418/55.3
5,403,172 A 4/1995 Blass et al.
6,030,193 A * 2/2000 Kimura ..... 418/55.3
6,113,371 A * 9/2000 Williams et al. ..... 418/55.3

FOREIGN PATENT DOCUMENTS

JP 02-091488 A * 3/1990
JP 04132888 A * 5/1992
JP 05223068 A * 8/1993
JP 05248369 A * 9/1993
JP 06081780 A * 3/1994
JP 2756808 B2 3/1998
JP 2003-106268 A 4/2003

OTHER PUBLICATIONS

Related co-pending U.S. Appl. No. 12/058,858; Ken Yanagisawa; "Scroll Fluid Machine"; filing date Mar. 31, 2008; Spec. pp. 1-18; Figs. 1-11b.

* cited by examiner

*Primary Examiner* — Theresa Trieu
(74) *Attorney, Agent, or Firm* — Rossi, Kimms & McDowell LLP

(57) ABSTRACT

A scroll fluid machine has a stationary scroll having a stationary scroll lap and an orbiting scroll having an orbiting scroll lap that orbits relative to the stationary scroll lap. The orbiting scroll lap engages with the stationary scroll lap to form a closed compression chamber. An intermediate ring is positioned to surround the orbiting scroll lap. A plurality of first plate springs connect the intermediate ring and the orbiting scroll, while supporting the intermediate ring to enable the intermediate ring to move in a first direction orthogonal to a rotation axis of the machine. A plurality of second plate springs connect the intermediate ring and the stationary scroll, while supporting the intermediate ring to enable the intermediate ring to move in a second direction orthogonal to the rotation axis of the machine as well as orthogonal to the first direction.

8 Claims, 11 Drawing Sheets

SCROLL FLUID MACHINE HAVING STATIONARY AND ORBITING SCROLLS HAVING A COUPLING MECHANISM TO ALLOW THE ORBITING SCROLL TO ORBIT RELATIVE TO THE SECOND SCROLL

BACKGROUND OF THE INVENTION

Field of the Invention

The present invention relates to a scroll fluid machine that makes a fluid be compressed, be expanded, and be pressurized/pumped. The invention relates especially to a turning mechanism according to which an orbiting scroll revolves.

Conventional scroll fluid machines are provided with a rotation prevention mechanism so that an orbiting scroll orbits around a stationary scroll in a regulated orbiting zone, without a self-rotation around an own axis. A pin-crank mechanism or an Oldham's coupling mechanism is used so as to realize the above-mentioned mechanism.

Here, with reference to FIGS. 11*a* to 11*d*, a brief explanation about a working principle as to a scroll compressor is given. The stationary scroll 011 has a spiral wall-shape lap installed upright on a flat plate placed vertically to a revolving shaft axis of the machine; an orbiting scroll 013 has a spiral wall-shape lap of the same shape as the stationary scroll lap; thereby, the spiral lap of the orbiting scroll 013 is engaged into that of the stationary scroll 011, being placed point-symmetrically (placed rotated by 180 degrees) to that of the stationary scroll 011; a crescent shaped closed space 015 (a compression chamber) is formed between an inner-side periphery surface 011*b* of the stationary scroll (011) spiral-lap and an outer-side periphery surface 013*a* of the orbiting scroll (013) spiral-lap; a volume of the crescent shaped closed space changes with a relative movement between the stationary scroll 011 and the orbiting scroll 013, making a gas induced from a suction side be compressed.

More specifically, in FIG. 11*a*, when a lap outer-side periphery (back) surface 013*a* of the orbiting scroll 013 and a lap inner-side periphery (belly) surface 011*b* of the stationary scroll 011 begin to form a sealed space, an inhaling process is finished; then, an inhaled gas through an inlet port 017 is confined to a compression chamber 015 as depicted with a region marked with dots in FIG. 11*a*; further, when a crank angle of a crank mechanism (not shown) proceeds by 90 degrees, the lap outer-side periphery surface 013*a* of the orbiting scroll 013 begin to separate from the lap inner-side periphery surface 011*b* of the stationary scroll 011 around a tail part of the stationary scroll, an open gap space 019 in FIG. 11*b* is formed; thereby, a gas intake process begins; further, an intermediate compression chamber 021 continues a compression process, and a central compression space 023 finishes a compression process so as to start a discharge process through an outlet port 025.

With a further advanced crank angle (of the above-mentioned crank mechanism) by 90 degrees, the situation in FIG. 11*b* proceeds to that in FIG. 11*c*; whereby, in response to an orbiting rotation (i.e. a revolution without rotation) of the orbiting scroll 013, the aforementioned dotted region 015 (the compression chamber 015) moves toward a further central location, reducing gradually own chamber volume; finally, a compressed gas of the chamber is discharged through the outlet port 025.

As described above, it is necessary for scroll compressors to be provided with a mechanism whereby the orbiting scroll revolves around an axis of the stationary scroll, without rotating movement. For this reason, the aforementioned Oldham's coupling mechanism or the pin-crank mechanism is installed between the stationary scroll 011 and the orbiting scroll 013.

FIG. 12 is a drawing to explain a working principle regarding an Oldham's coupling mechanism; a disk 031 is placed between an input shaft 038 and an output shaft 036 whereby both shaft axes are a little eccentric although the axes are parallel; there are key-boss type protrusions (032 and 033) on both parallel surfaces of the disk 031; here, the lines of the protrusions 032 and 033 lie at right angles each other; in response to the protrusions 032, there is a key-way type groove 035 for sliding the key-boss type protrusions 032, on a surface plane of an input shaft-flange-part disk 034; on the other hand, in response to the protrusions 033, there is a key-way type groove 037 for sliding the key-boss type protrusions 033, on a surface plane of an output shaft-flange-part disk 036; hereby, a line of the key-way type groove 035 intersects the axis of the input shaft 038 or the input shaft-flange-part disk 034 whereas a line of the key-way type groove 036 intersects the axis of the output shaft 039 or the output shaft-flange-part disk 036. The rotation movement of the input shaft 038 is transmitted to the output shaft 039 through the disk 031, with a same rotation speed.

Further, if the rotational movement of the output shaft is fixed, then the input shaft has to orbit (revolve) around the axis of the output shaft. This orbiting movement mechanism can be applied to a scroll fluid machine.

An application example of an Oldham's coupling mechanism for scroll fluid machines is disclosed in a patent reference 1 (JP Patent No. 2756808). In the reference, as shown in FIG. 13*a*, a stationary scroll 051 that has a spiral lap installed upright to the scroll 051 is fixed to a casing 052; an orbiting scroll 054 that has a spiral scroll in a similar way is connected to the casing 052 through an Oldham's coupling 059; the lap 053 of the orbiting scroll 054 and the lap 050 of the stationary scroll 051 engage with each other, forming a compression chamber 055; the chamber 055 pressurizes a gas therein while moving and getting less bulky.

As shown in FIG. 13*b*, the Oldham's coupling 059 comprises a ring-like element 060 that has key-boss type protrusions 063 on a flat first side-face of the ring-like element 060 and key-boss type protrusions 064 on a flat second side-face of the element 060; whereby, a line connecting the protrusions 063 and a line connecting the protrusions 064 lie at right angles each other; in addition, the protrusions 063 and 064 are made of piled-up carbon-fibers strengthened with resin so as to meet wear-resistance requirements.

A patent reference 2 (JP-A-2003-106268) discloses a scroll fluid machine provided with a pin-crank mechanism. In the reference 2, as shown in FIGS. 14*a* and 14*b*, a stationary scroll 070 and a orbiting scroll 071 form a compression chamber 072; an eccentric shaft that forms an end of a shaft 073 is engaged in an orbiting bearing 074 fitted in the orbiting scroll 071.

In order to deter the orbiting scroll from rotating around an axis of the eccentric shaft as well as from moving out of the right locus during revolution movement, is disclosed a pin-crank mechanism 079 which comprises an orbiting pin-bearing 075 fitted to a base plate part of the orbiting scroll, a first stationary bearing 076 fitted into a hole made in a body-frame, a second stationary bearing 077 fitted to a further bottom side of the hole, and a pin-crank shaft 078 that is supported by the three kinds of rolling-element bearings; whereby, in usual practice, three sets of the mechanism are arranged at equal intervals on a circle.

As shown in FIG. 12, an Oldham's coupling mechanism cannot do without a key-way type groove and a key-boss type protrusion that is engaged therein and slides therein; thus, the mechanism is easy to accompany vibration problems, noise problems, excessive clearance-wear problems due to frictions; therefore, in the manner of the patent reference 1 (FIG. 12), wear-resistant materials are adopted to the friction-wear parts of the mechanism.

On the other hand, a configuration of a pin-crank shaft of the pin-crank mechanism is complicated as the mechanism for scroll fluid machines is shown in FIG. 14; the complication accompanies expensive machining cost; further, angular-type ball bearings are needed for properly bearing an axial force that works on the pin-crank shaft so as to secure an axial clearance between the orbiting scroll and the body-frame; thereby, another cost impact occurs.

Moreover, lubricating oil or grease has to be supplied to the bearing for the pin-crank shaft; the temperature management for the bearings is also needed; in addition, there may be troubles as to operation noise around the bearings as well as to wear-increase, namely, the clearance-increase.

Thus, an operation and/or maintenance without lubricant-supply is difficult because the fluid machine needs counter-measures in advance as to the mentioned lubrication and wear-resistance, whether the machine uses an Oldham's coupling mechanism or a pin-crank mechanism; even if an Oldham's coupling mechanism with elements made of self-lubricating materials is applied, longitudinal/radial clearance-increases due to wear are hard to be fully evaded as long as there are friction parts in the Oldham's coupling mechanism.

In addition, it is also difficult to do without lubricant such as oil or grease only for relative sliding-movement between orbiting scroll laps and stationary scroll lap, although it is desired to do so. The reason of this difficulty is that an Oldham's coupling mechanism or a pin-crank mechanism needs as sufficient lubricants as required and a part of the sufficient lubricants absolutely flows into scroll lap parts. Thus, lubricant-free scroll fluid machines are conventionally difficult to be realized.

SUMMARY OF THE INVENTION

The present invention is created in view of the above-mentioned technical background. The subject of the invention is to provide a scroll fluid machine with a mechanism in which a relative orbiting (revolution) movement is possible between a orbiting scroll and a stationary scroll, whereby the mechanism can do without a couple of engaging/sliding elements such as used in an Oldham's coupling mechanism or a pin-crank mechanism.

A first embodiment of the invention to solve the above-mentioned subject is brought by a mechanism of a scroll fluid machine, comprising:

a first scroll lap, a second scroll lap that is engaged with the first scroll lap and forms a closed compression chamber, together with the first scroll lap, an intermediate element that is placed so as to transmit a torque between a first scroll having the first scroll lap and a second scroll having the second scroll lap, a first plate sprig element that connects the intermediate element to the first scroll and supports the intermediate element so as to enable the intermediate element to move in a first direction orthogonal to a rotation axis (of the machine), and a second plate sprig element that connects the intermediate element to the second scroll and supports the intermediate element so as to enable the intermediate element to move in a second direction orthogonal to the rotation axis (of the machine) as well as orthogonal to the first direction;

whereby, a revolution/rotation axis of the first scroll and a rotation axis of the second scroll are placed with an eccentricity, and the first scroll can revolute relatively around the second scroll.

According to the above embodiment, it becomes possible for the first scroll and the second scroll having the second scroll lap, which forms a closed compression chamber by engaging with the first scroll lap, to be translated parallel to each other. Moreover, because of a possible relative-parallel-translation movement between rotating/revolving axes of the first scroll and the second scroll with an eccentricity therebetween, as well as because of the omission of sliding contact parts such as incorporated in an Oldham's coupling mechanism or a pin-crank mechanism on condition that a self-rotation movement of an orbiting scroll can be prevented, it becomes possible to achieve less wear-base deterioration due to sliding part-free configuration as well as to achieve enhanced wear durability around rotationally-sliding parts due to less clearance-growth.

Moreover, the sliding part-free configuration makes it possible to do without lubrication oil or grease; thus, an easy maintenance management of the scroll fluid machine can be realized. In addition, the sliding part-free configuration can reduce driving energy of the scroll fluid machines and yields less noise or less vibration of the machines.

A second preferable embodiment is the scroll fluid machine of the first embodiment, whereby the intermediate element is formed in a ring-shape and is arranged so as to surround the first scroll lap of the first scroll and the second scroll lap of the second scroll. In this configuration, the ring-shaped intermediate element is placed outside of where the first and second scrolls mesh each other, so that the ring shaped intermediate element surround the scrolls. Thus, the intermediate element does not require additional space to be fitted in the axial direction.

A third preferable embodiment of the invention is an embodiment in which the second scroll in the first embodiment is a stationary scroll that is fixed to a casing of the machine, and the first scroll in the first embodiment is an orbiting scroll that revolves around an axis of the second scroll with a radius equal to the before-mentioned eccentricity.

According to the above embodiment, it becomes possible that the orbiting scroll as the first scroll revolves around the stationary scroll as the first scroll, without rotational movement of the orbiting scroll itself, whereas an axial clearance between the orbiting scroll and the second scroll is secured.

That is, a structure of a scroll fluid machine can be simply configured so that a relative orbiting movement between the orbiting scroll and the stationary scroll is performed by means of making the orbiting scroll revolve around the axis of the stationary scroll, with a radius of the eccentricity of a eccentric crank shaft; thereby, a closed compression chamber formed by an engagement of the orbiting scroll lap and the stationary scroll lap is directed toward the revolution center, while the volume of the chamber gradually reduces.

Since the scroll fluid machines configured as described above enables to do without sliding parts such as used in conventional Oldham's coupling mechanisms or pin-crank mechanisms as well as to provide the orbiting scroll with a self-rotating prevention mechanism, the machines can be free from wear-based deterioration thanks to sliding-part-free configuration as well as can enhance durability against an increase as to rotational part clearances; in addition, the sliding-part-free configuration enables to dispense with lubrication oil or grease, realizing easy maintenance machine-management.

A fourth preferable embodiment of the invention is an embodiment in which the second scroll is a driven scroll that rotates around the rotation axis of the second scroll and is supported by the casing of the machine, while the second scroll is rotated by the first scroll the axis of which eccentric against the axis of the second scroll with the eccentricity; further, a relative revolving (orbiting) movement is performed between the first scroll and the second scroll.

According to the above embodiment, even with an eccentricity between the rotational axis of the driving scroll and that of the driven scroll, a rotational force given to the driving scroll makes a rotational movement of the driving scroll be transmitted to the driven scroll, through a coupling mechanism comprising the intermediate element, the first plate sprig element, and the second plate sprig element, thanks to a rotation-free configuration as to the driving scroll and the driven scroll; in addition, the force can bring a relative revolution movement (an orbiting movement) between the driving scroll and the driven scroll.

Namely, when a drive-motor gives the drive scroll a rotational movement around a rotational axis of the driving scroll, the rotational movement is transmitted to the driven scroll while axial clearances of the fluid machine are kept substantially constant; in addition, a relative revolution movement (an orbiting movement) between the driving scroll and the driven scroll is performed so that a closed compression chamber formed by an engagement of the orbiting scroll lap and the stationary scroll lap is directed toward the revolution center, while the volume of the chamber gradually reduces; thus, a scroll fluid machine can be completed with a simplified structure.

A scroll fluid machine configured as in the above embodiment can dispense with sliding parts such as used in conventional Oldham's coupling mechanisms or pin-crank mechanisms as well as can provide the orbiting scroll with a self-rotating prevention mechanism, as the situation is the same as in the preceding embodiment; thus, the machines can be free from wear-based deterioration thanks to sliding-part-free configuration as well as can enhance durability against an increase as to rotational part clearances; further, the sliding-part-free configuration enables to dispense with lubrication oil or grease, realizing further maintenance-free machine-operation; moreover, the sliding part-free configuration reduces driving energy of the scroll fluid machines and yields less noises or vibrations of the machines.

A fifth preferable embodiment of the invention is an embodiment of the above embodiment 1, 2, 3 or 4; whereby, a configuration of this embodiment comprises a polygon-shape and a ring-shape (loop-shaped) intermediate element as the intermediate element; whereby, a pair of the first plate sprig elements are fitted to opposite-side edges (locations) of the polygon or the ring, and a pair of the second plate sprig elements are fitted to another opposite-side edges (locations) of the polygon or the ring; whereby, the former opposite-side edges (locations) coincide with the latter opposite-side edges (locations) when the former edges (locations) or the latter edges (locations) are rotationally moved by 90 degrees in a plane orthogonal to the axis of the machine.

According to the above embodiment, since a pair of the first plate sprig elements and the second plate sprig elements are evenly fitted to opposite-side edges (locations) of the intermediate element, an equally driving torque works on an outer-periphery of the intermediate element; thus, a smooth relative revolution (orbiting) movement between the first scroll and the second scroll is realized.

A sixth preferable embodiment of the invention is an embodiment of any one of the above embodiments 1 to 5; whereby, the first plate spring element and the second plate spring element are of an oval track shape; a part of a line part of the oval track of the first plate spring element is fitted to the intermediate element, while a part of another line part of the oval track of the first plate spring element is fitted to the first scroll; on the other hand, a part of a line part of the oval track of the second plate spring element is fitted to the intermediate element, while a part of another line part of the oval track of the second plate spring element is fitted to the second scroll.

According to the above embodiment, a long side of the oval track of the first or second plate spring can be fitted on the intermediate element and the first scroll side part or the second scroll part; thus, the fitting of the first and second plate springs are secured with long fitting length.

A seventh preferable embodiment of the invention is an embodiment according to the above embodiment 4 or 5; wherein, a plurality of the first plate springs and a plurality of the second plate springs are placed on each edge of the intermediate element.

According to the above embodiment, since a plurality of the plate spring elements are fitted to each polygon edge of the intermediate element, an enhanced stiffness as to an axial direction of the fluid machine is obtained; namely, an axial clearance between the first scroll and the second scroll is kept further constant; consequently, a desirable condition regarding sliding movement between a tip part of the first scroll lap and the second scroll is preserved; in the same way, a desirable condition regarding sliding movement between a tip part of the second scroll lap and the first scroll is preserved; as a result, it becomes possible to expect a desirable sealing condition of the aforementioned compression chamber formed through an engagement of the first scroll and the second scroll.

Thus, without a sliding and engaging mechanism such as used in conventional Oldham's coupling mechanisms or pin-crank mechanisms, the present invention provides a scroll fluid machine wherein a relative revolution (orbiting) movement between the first scroll and the second scroll can be performed.

BRIEF DESCRIPTION OF THE DRAWINGS

The present invention will now be described in greater detail with reference to the preferable modes of the invention and the accompanying drawings, wherein.

Figure 11A:
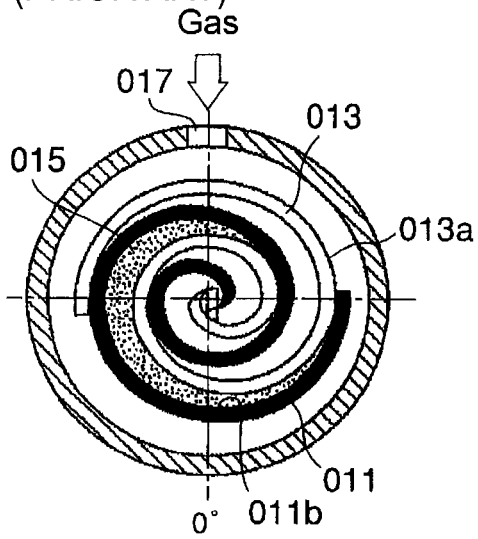
FIG.11a (PRIOR ART)
FIGS. 11*a* to 11*d* explain a principle of compression process of a scroll fluid machine, wherein the situation of FIG.
Figure 11B:
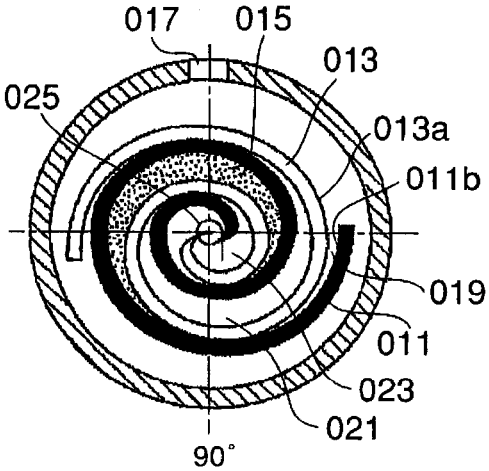
FIG. 11b (PRIOR ART)
Figure 11C:
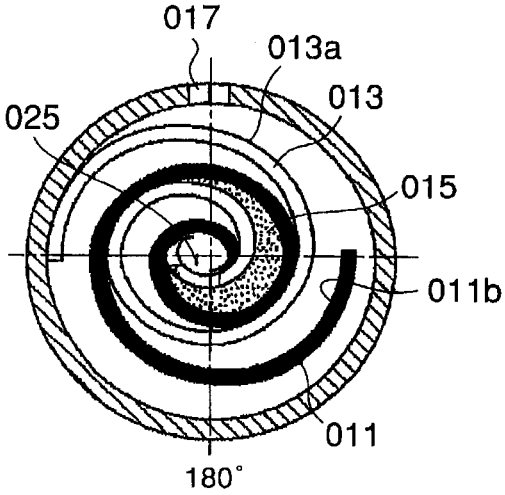
FIG. 11c (PRIOR ART)
Figure 11D:
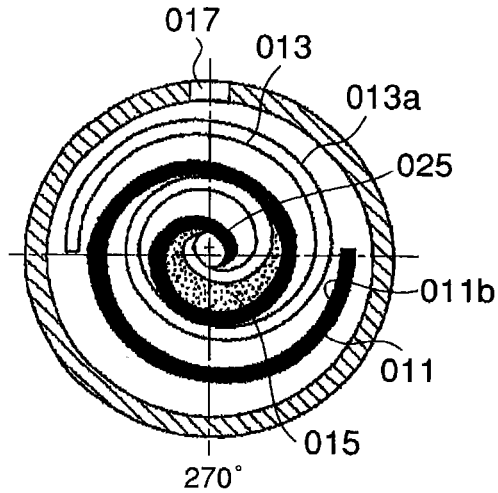
FIG. 11d (PRIOR ART)
Figure 12:
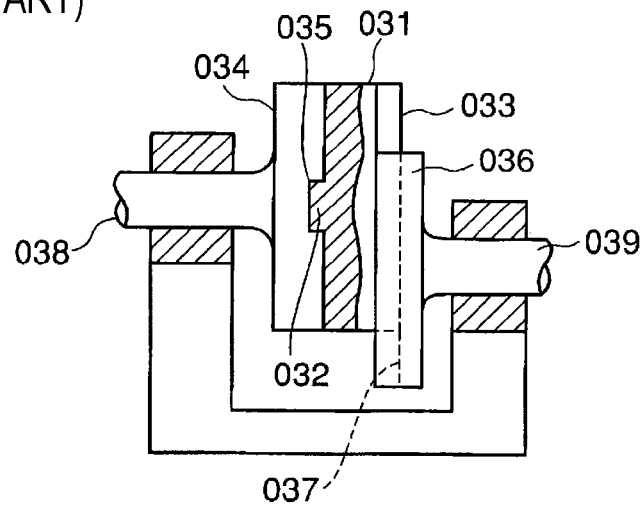
FIG. 12 (PRIOR ART)
Figure 13A:
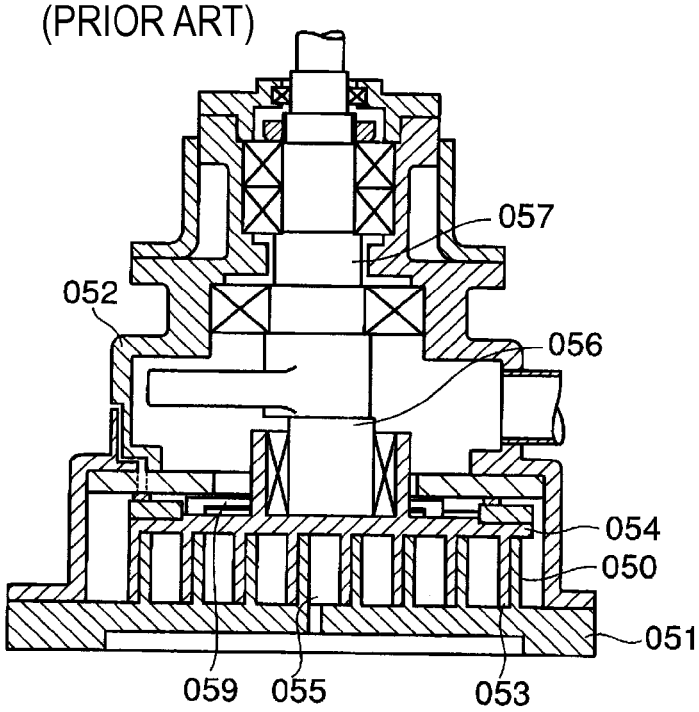
FIG. 13a (PRIOR ART)
Figure 13B:
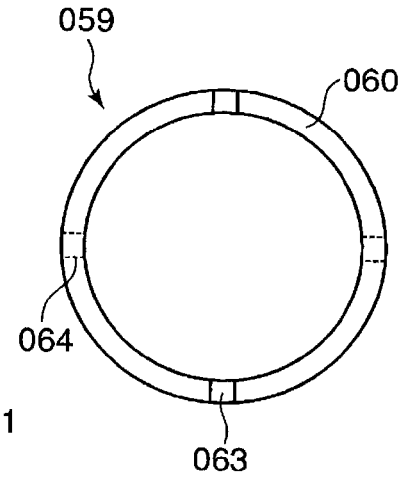
FIG. 13b (PRIOR ART)

11*a* proceeds to those of FIG. 11*b*, FIG. 11*c*, and FIG. 11*d* in sequence, as the revolution angle of an orbiting scroll around a stationary scroll advances every 90 degrees;

FIG. 12 shows an explanation of a conventional technology;

FIG. 13 shows an explanation of a conventional technology; and

Figure 14A:
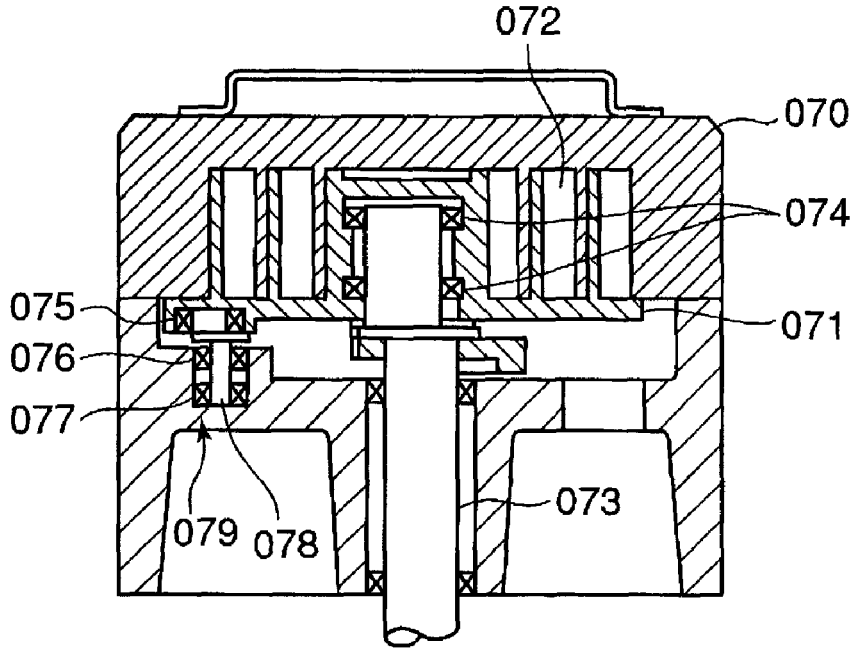
FIG. 14a (PRIOR ART)
Figure 14B:
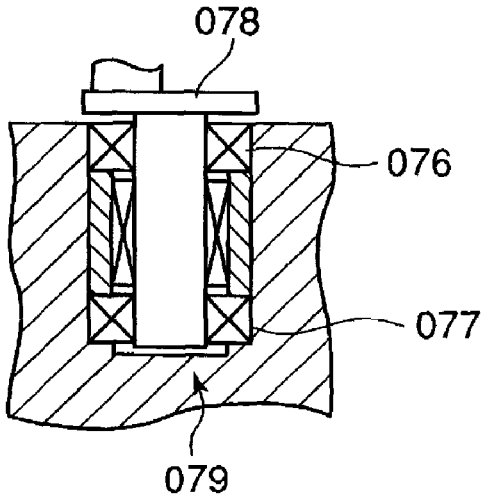
FIG. 14b (PRIOR ART)

FIGS. 14*a* and 14*b* show an explanation of a conventional technology.

DETAILED DESCRIPTION OF THE PREFERRED EMBODIMENTS

Hereafter, the present invention will be described in detail with reference to the invention modes shown in the figures. However, the dimensions, materials, shape, the relative placement and so on of a component described in these invention modes shall not be construed as limiting the scope of the invention thereto, unless especially specific mention is placed.

Figure 1:
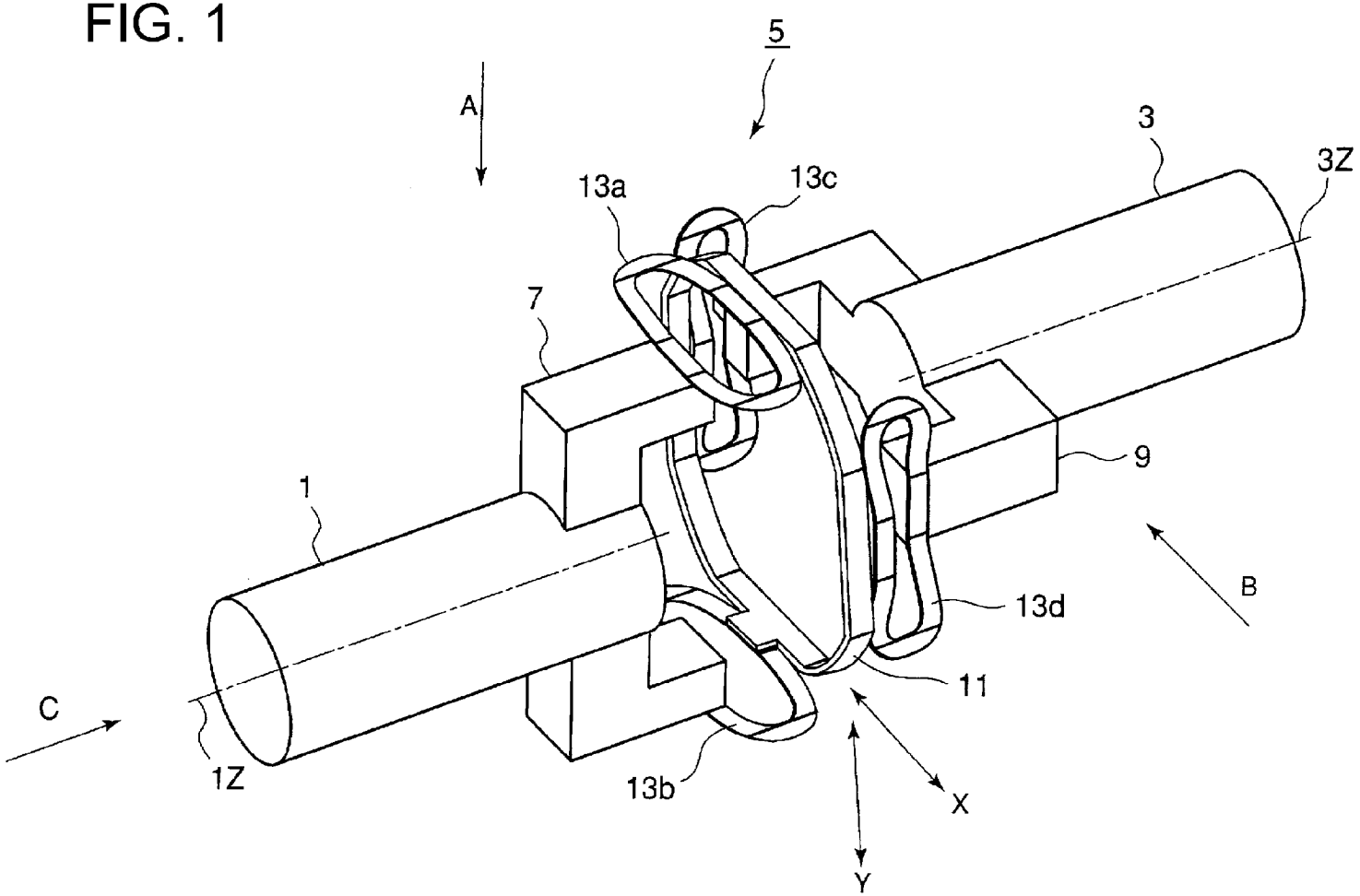
FIG. 1 shows a perspective view as to a whole constitution of a coupling mechanism in which a principle of a revolution (orbiting) mechanism of the invention is explained.
Figure 2:
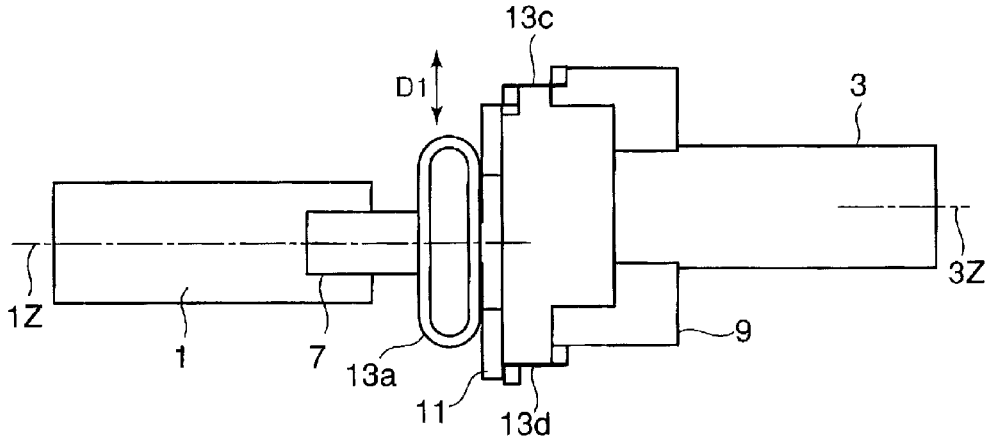
FIG. 2 shows an A-arrow view of FIG. 1.
Figure 3:
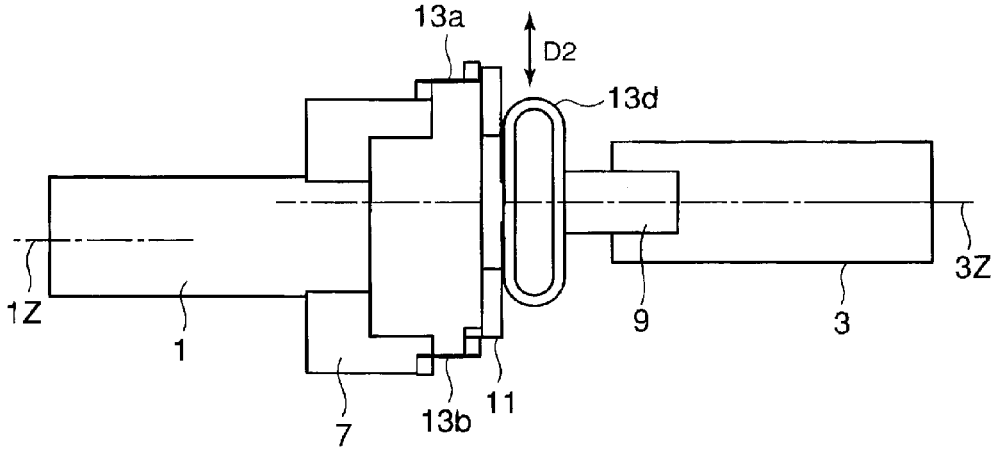
FIG. 3 shows a B-arrow view of FIG. 1.
Figure 4:
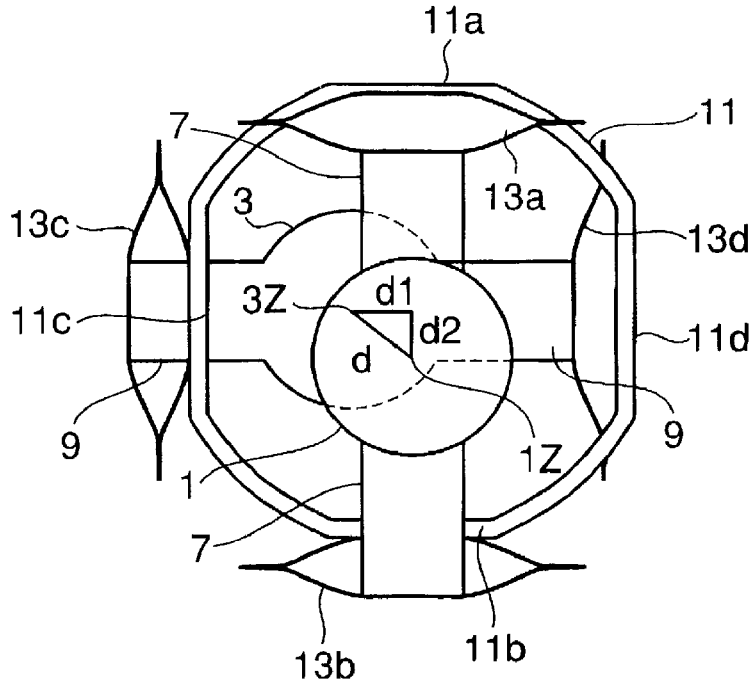
FIG. 4 shows a C-arrow view of FIG. 1.
Figure 6:
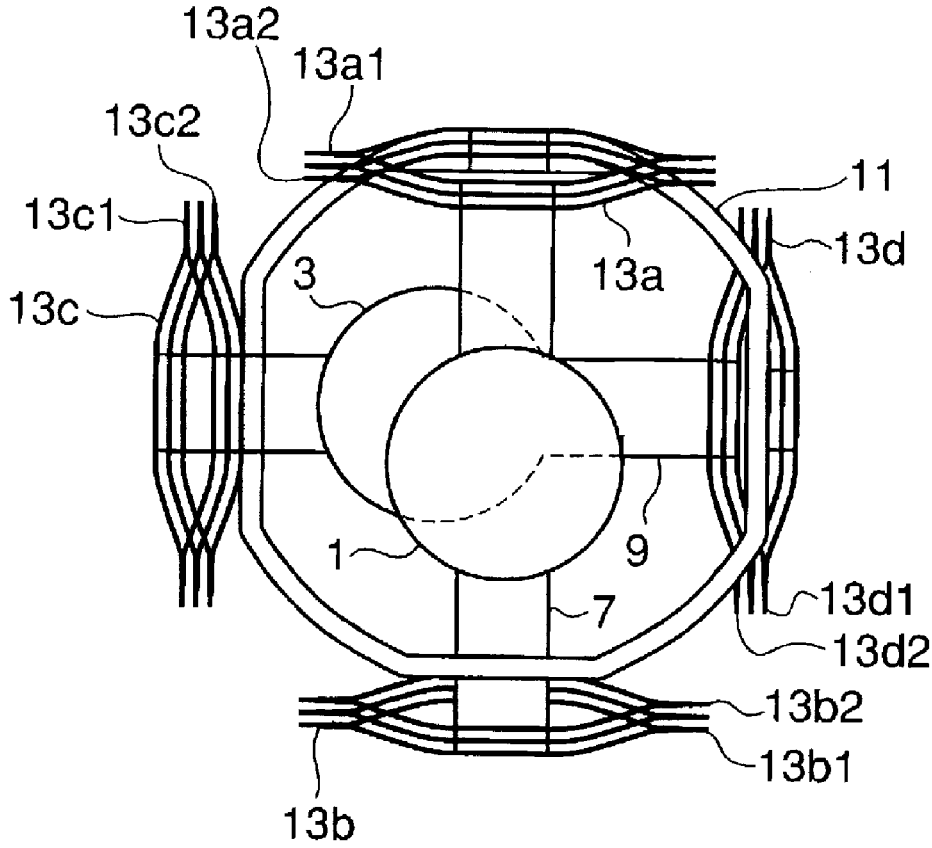
FIG. 6 also shows a variation example of a plate spring element.
Figure 7:
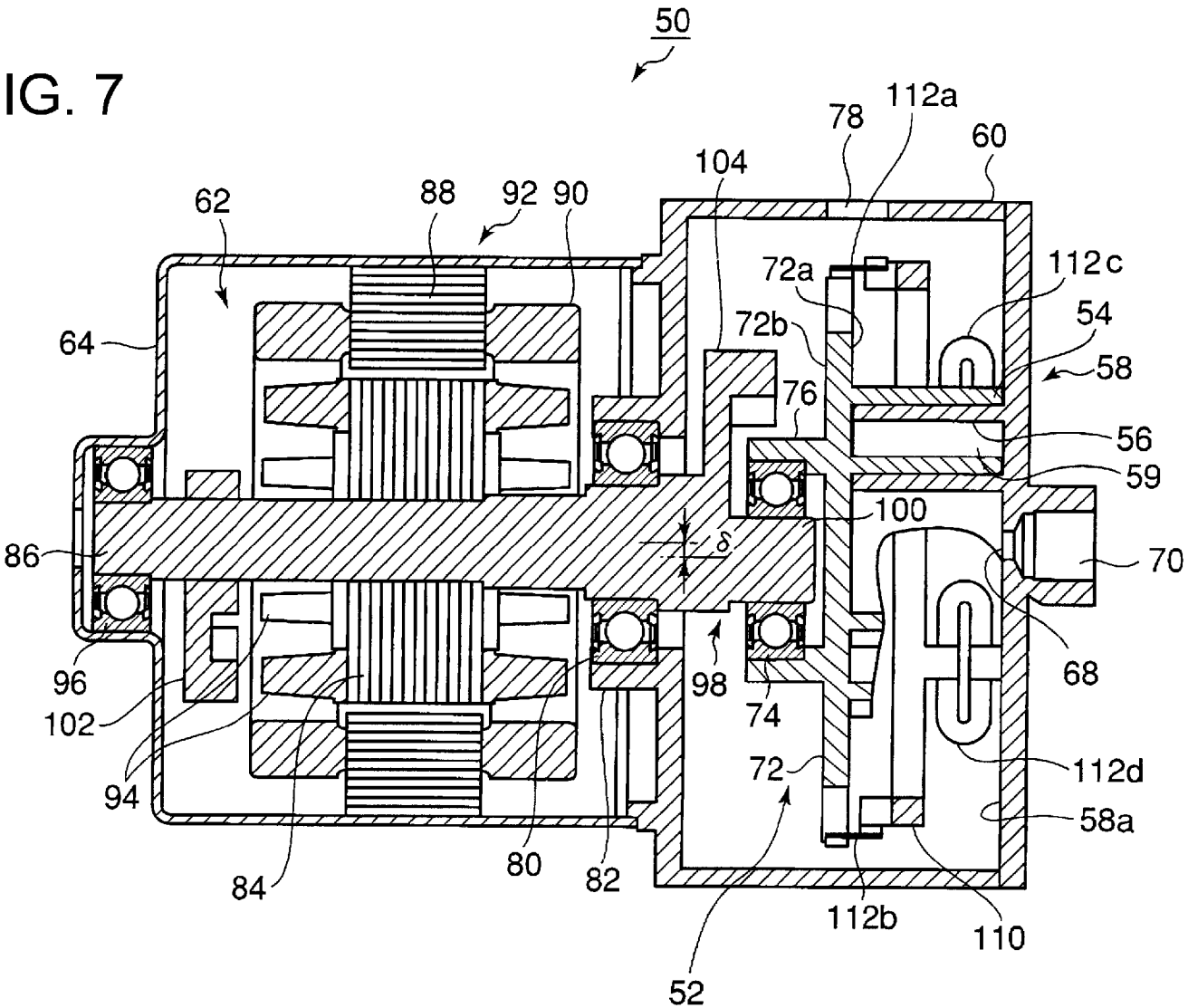
FIG. 7 shows a whole constitution of a scroll fluid machine according to the first preferable mode.
Figure 8:
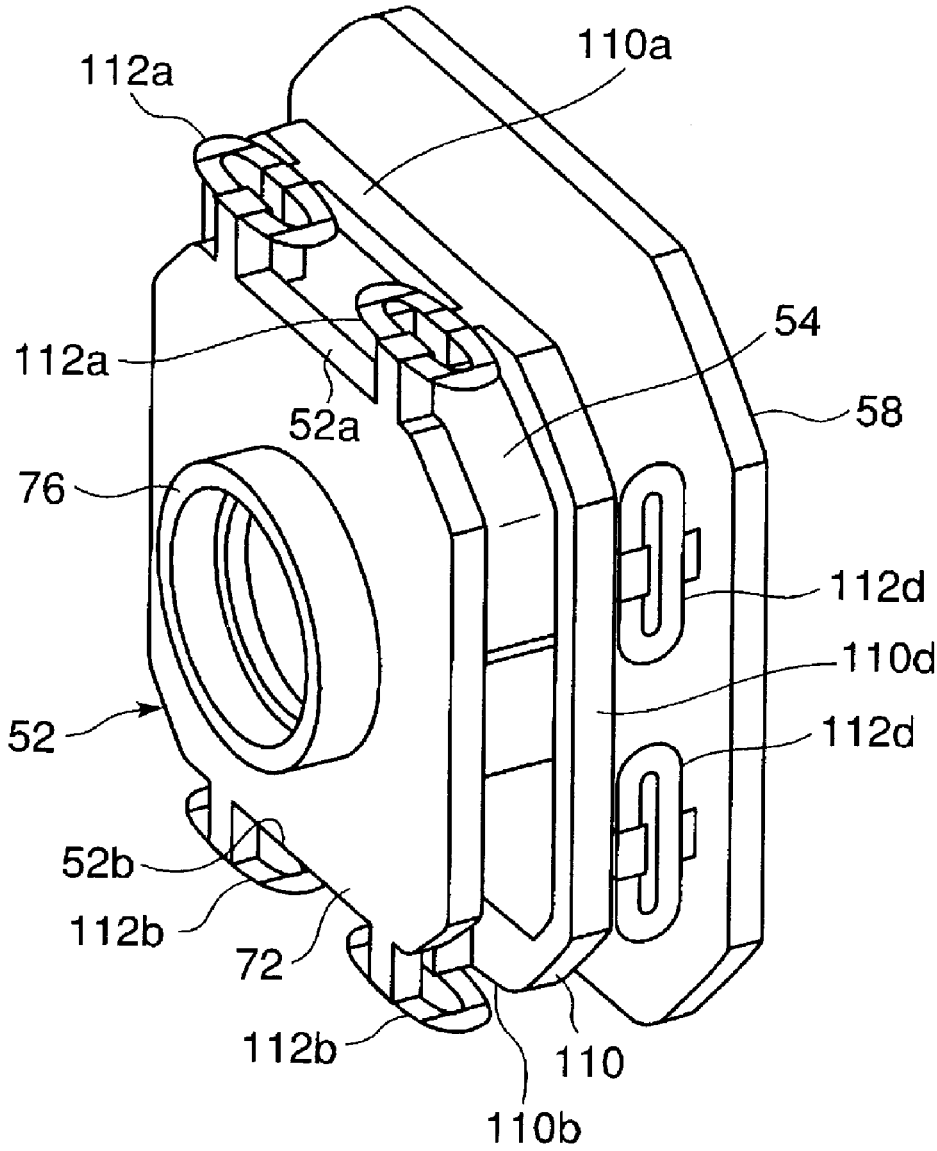
FIG. 8 shows a perspective view as to principal parts of a scroll fluid machine according to the first preferable mode.
Figure 9:
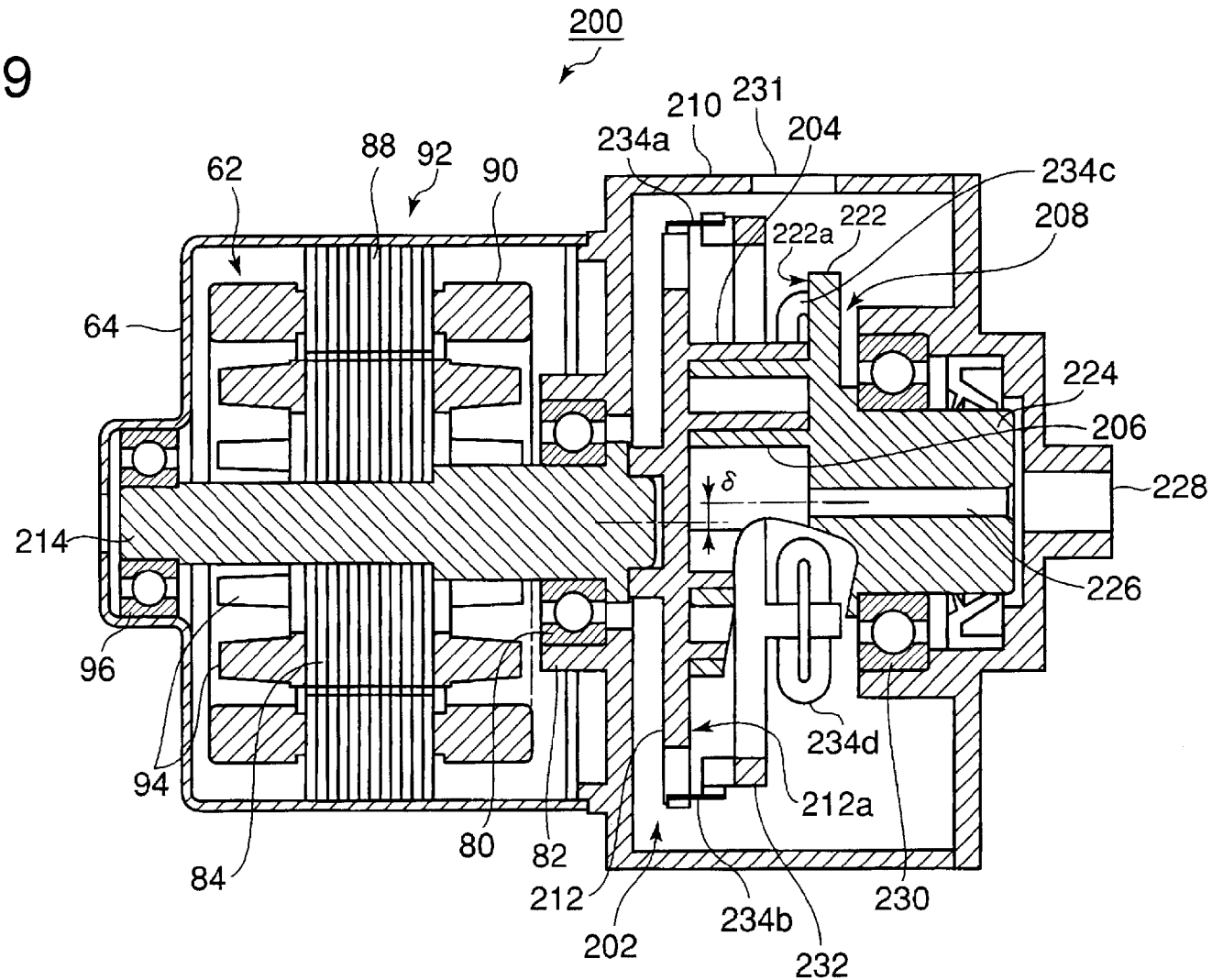
FIG. 9 shows a whole constitution of a scroll fluid machine according to the second preferable mode.
Figure 10:
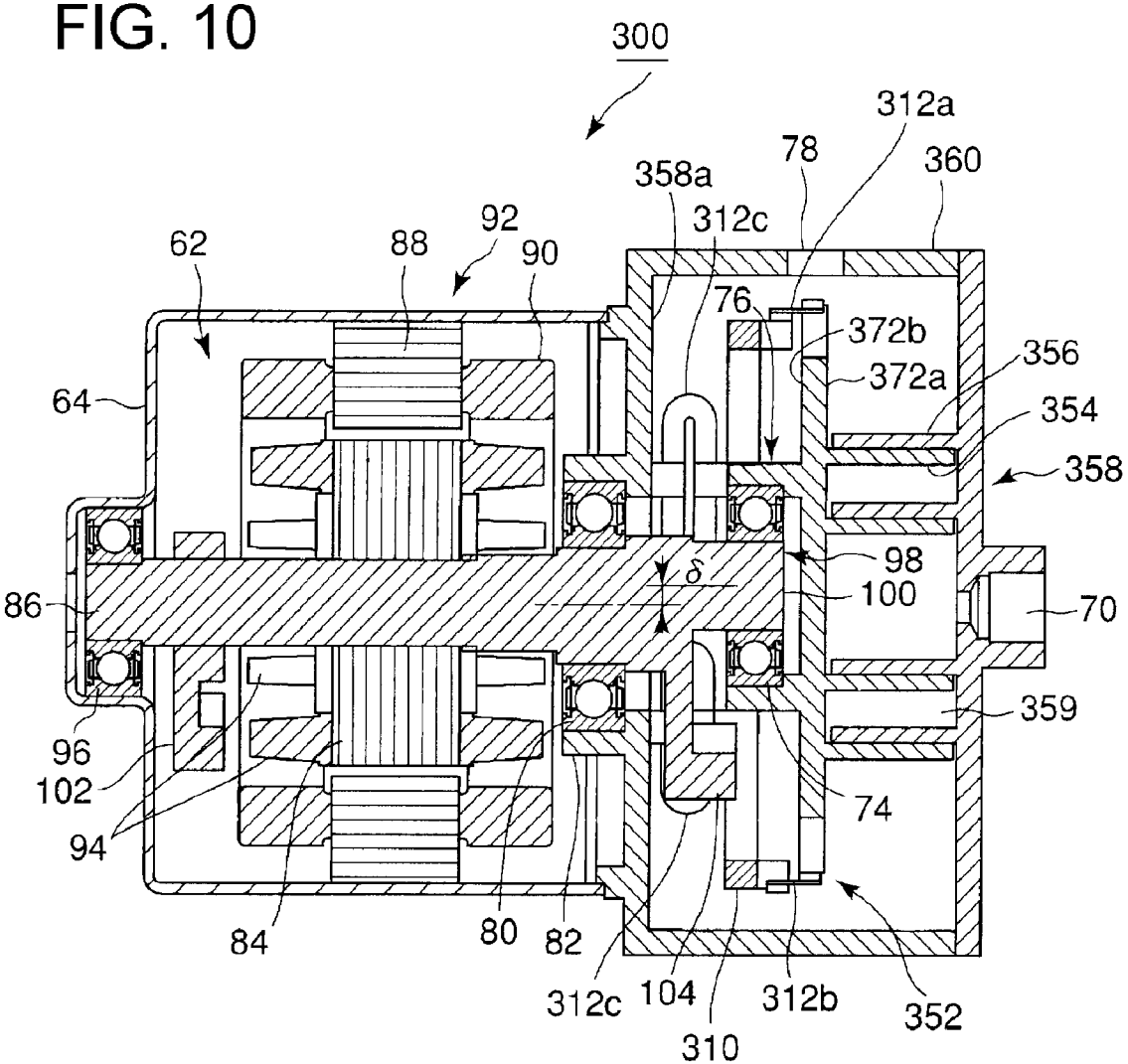
FIG. 10 shows a whole constitution of a scroll fluid machine according to the third preferable mode.

In the attached drawings, FIG. 1 shows a perspective view as to a whole constitution of a coupling mechanism in which a principle of a revolution (orbiting) mechanism of the invention is explained; FIG. 2 shows an A-arrow view of FIG. 1; FIG. 3 shows a B-arrow view of FIG. 1; FIG. 4 shows a C-arrow view of FIG. 1; FIG. 5 shows a variation example of a plate spring element; FIG. 6 shows another variation example of a plate spring element; FIG. 7 shows a whole constitution of a scroll fluid machine according to the first invention mode; FIG. 8 shows a perspective view as to principal parts of a scroll fluid machine according to the first invention mode; FIG. 9 shows a whole constitution of a scroll fluid machine according to the second invention mode; FIG. 10 shows a whole constitution of a scroll fluid machine according to the third invention mode; FIGS. 11*a* to 11*d* explain a principle of compression process of a scroll fluid machine, wherein the situation of FIG. 11*a* proceeds to those of FIG. 11*b*, FIG. 11*c*, and FIG. 11*d* in sequence, as the revolution angle of an orbiting scroll around a stationary scroll advances every 90 degrees.

At first, before an explanation as to a scroll fluid machine is given, a revolving (orbiting) mechanism is explained with an example of a coupling mechanism according to the present invention.

As shown in FIG. 1, a coupling mechanism 5 that performs a rotation movement transmission from a drive-shaft 1 to a driven shaft 3 wherein the axes of the two shaft are parallel to each other, with an eccentricity. A square U-shaped part 7 is formed at an end of the drive-shaft 1 while a square U-shaped part 9 is formed at an end of the driven shaft 1; whereby, the both ends of the two shafts are placed so as to face each other; in addition, each plane including each of the U-shaped parts intersects each other with substantially right angle.

Between the square U-shaped part 7 and the square U-shaped part 9, is located an intermediate ring (an intermediate element) 11 the rotating plane of which is vertical to an axis 1Z of the drive-shaft 1 as well as an axis 3Z of the driven shaft 3. The intermediate ring 11 of steel is substantially octagonal; to each of opposing (counter-facing) edges of the intermediate ring, namely, an upper edge 11*a* and a lower edge 11*b*, a longer part of the oval track-shape element as the first plate spring element is fastened by welded joints or with bolts. In addition, another longer part of the first plate spring element 13*a* or 13*b* is fastened to either of outer-end sides of the aforementioned square U-shaped part 7, by welded joints or with bolts.

The first plate springs 13*a* and 13*b* of spring steel can deflect so that the springs mainly deform (mainly due to the elasticity of a circular part of the oval track) in a minor axis direction of the oval track, namely, in the Y-direction in FIG. 1; here, the Y-direction is an above or below direction (a vertical direction), and is defined as a first direction vertical to the axes 1Z and 3Z, for the convenience of later description; anyway, the intermediate ring 11 can be fitted so as to move in the first direction within an allowable amplitude of the springs 13*a* and 13*b*.

In a way similar to the above, to opposing (counter-facing) edges (left and right side edges) of the intermediate ring, namely, an edge 11*c* and an edge 11*d*, a longer part of the oval track-shape element as the second plate spring element 13*c* or 13*d* is fastened by welded joints or with bolts; in addition, another longer part of the second plate spring element 13*a* or 13*b* is fastened to either of outer-end sides of the aforementioned square U-shaped part 9, by welded joints or with bolts; wherein, it is noted that the left and right side edges 11*c* and 11*d* of the intermediate ring correspond to the upper and lower edges when the ring is rotated around the rotation axis of the ring, by 90 degrees.

The second plate spring elements 13*c* and 13*d* are made of spring steel as the first plate spring elements 13*a* and 13*b* are; the second plate spring elements 13*c* and 13*d* can deflect so that the springs mainly deform (mainly due to the elasticity of a circular part of the oval track) in a minor axis direction of the oval track, namely, in the X-direction in FIG. 1; here, the X-direction is an left or right direction (a horizontal direction), and is defined as a second direction vertical to the axes 1Z and 3Z, for the convenience of later description; anyway, the intermediate ring 11 can be fitted so as to move in the second direction within an allowable amplitude of the springs 13*c* and 13*d*.

In the coupling mechanism 5 configured as above, when a torque works around the drive-shaft 1, a shearing force acts on the first plate springs 13*a* and 13*b* in a D1-direction in FIG. 2, so as to transmit the torque to the intermediate ring 11 through which a shearing force acts on the second plate springs 13*c* and 13*d* in a D2-arrow direction in FIG. 3; Thus, the torque is transmitted to the driven shaft 3.

Further, as shown in FIG. 4, there is an eccentricity with a distance d between the axis 1Z of the drive-shaft 1 and the axis 3Z of the driven shaft 3; however, an eccentricity d1, i.e. an X-direction component of d can be absorbed by a deflection of the second plate springs 13*c* and 13*d*, while an eccentricity d2, i.e. an y-direction component of d can be absorbed by a deflection of the first plate springs 13*a* and 13*b*.

Hence, a rotation movement inputted in the drive-shaft 1 can be transmitted to the driven shaft 3 through the first springs 13*a* and 13*b*, the intermediate ring 11, and the second plate springs 13*c* and 13*d*; as a result, the coupling mechanism 5 can be realized with a plate spring mechanism, without conventional Oldham's coupling mechanisms or pin-crank mechanisms; in addition, since there is no sliding parts in the mechanism of the invention, the machines according the invention are free from deterioration due to wear; further, the machines of the invention can be free from wear-based deterioration thanks to sliding-part-free configuration as well as can enhance durability against an increase as to rotational part clearances; further, the sliding-part-free configuration enables to dispense with lubrication oil or grease, realizing further maintenance-free machine-operation; moreover, the sliding part-free configuration reduces driving energy of the scroll fluid machines and yields less noises or vibrations of the machines.

Figure 5A:
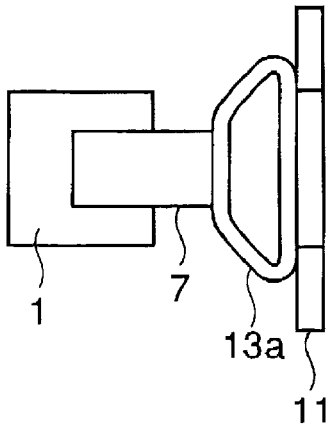
FIGS. 5*a* and 5*b* show a variation example of a plate spring element.
Figure 5B:
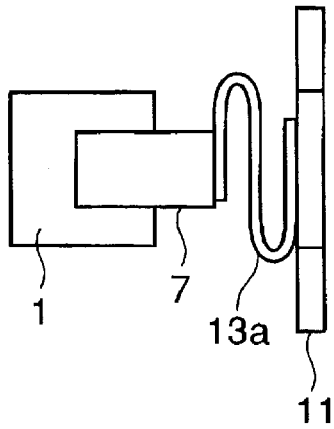

FIGS. 5*a* and 5*b* show another variation examples of the first plate spring elements 13*a* and 13*b* as well as the second plate spring elements 13*c* and 13*d*. In FIG. 5*a* is shown a trapezoid-shaped ring plate spring; whereby, the plate spring can be fixed to the intermediate ring 11 with a fitting length longer than a straight length of the aforementioned oval track; thus, a secured fitting is possible. Further, in FIG. 5*b*, is shown a S-shaped plate spring; whereby, an end of the letter S is fixed to the aforementioned square U-shaped part, and another end of the letter S is fixed to the intermediate ring; thus, an increased deflection becomes possible (in comparison with a case of plate spring elements of an oval track shape or a trapezoid-shaped); hence, durability of plate springs is enhanced; moreover, an increased eccentricity between the axes of the drive-shaft and the driven shaft, i.e. an enlarged allowable deflection of the plate springs in X-direction or Y-direction. By the way, the plate springs are not necessarily of a ring shape; the plate springs may be those of flat plate; further, the plate springs may be made of a plurality of plate springs such as those of superposed plate layers.

Further, in FIG. 6, is shown a variation of a manner in which the first plate springs 13*a* and 13*b* as well as the second plate springs 13*c* and 13*d* are provided; namely, is shown an example in which a plurality of the first/second springs are provided; in fact, in FIG. 6, are depicted plural first plate springs including those marked with 13*a*1, 13*a*2, 13*b*1 and 13*b*2 as well as plural second plate springs including those marked with 13*c*1, 13*c*2, 13*d*1 and 13*d*2; in this way, by means of laying a plurality of plate springs, enhanced stiffness is obtained; as a result, since an axial direction rigidity between the drive-shaft 1 and the driven shaft 3 is also heightened, a relative displacement between the shafts 1 and 3 is kept constant, although a deflection of the first/second plate springs in X-direction and Y-direction becomes smaller.

In the coupling mechanism 5 explained in the above, when the driven shaft 3 is placed at a standstill, a rotation (orbiting) mechanism can be realized so that the drive-shaft 1 can revolve (orbit) around the axis 3Z of the driven shaft 3; that is, it becomes possible that the axis 1Z of the drive-shaft 1 can perform a parallel translation around the axis 3Z of the driven shaft 3 on a condition that a relative axial movement (in 1Z-direction or 3Z-direction) between the axis 1Z and the axis 3Z is kept substantially zero. In other words, the premise means that the opposing (counter-facing) end face planes of the drive-shaft 1 and the driven shaft 3 are substantially parallel with a substantially constant distance.

Hereafter, a first invention mode of the above-mentioned revolving mechanism that is applied to a scroll compressor will be described with reference to FIGS. 7 and 8.

In FIG. 7, a scroll compressor 50 comprises:

an orbiting scroll (a first scroll) 52 comprising an orbiting scroll lap (a first scroll lap) 54, a stationary scroll (a second scroll) 58 comprising a stationary scroll lap (the second scroll lap) 56, a scroll casing 60 that covers the orbiting scroll 52 and fixes the stationary scroll 58, and a motor casing 64 that has a drive motor 62 therein, whereby the motor 62 drives the orbiting scroll 52.

In addition, the stationary scroll 58 is provided with a discharge port 68 at a center part of a mirror surface 58*a* that is an inner side surface of the stationary scroll 58 of a disk shape; whereby, the discharge port 68 is connected to a discharge mouth 70. The stationary scroll lap 56 of a spiral wall shape is implanted in the inner side surface of the stationary scroll 58; here, the spiral starts from the center part of the mirror surface 58 toward an outer circumference circle. In a groove engraved on a tip ridge surface of the stationary scroll lap 56, is installed a tip seal (not shown) of self-lubricating material.

As shown in the perspective view of FIG. 8, an end plate 72 of the orbiting scroll 52 is substantially of an octagonal plate shape that is obtained from a square plate shape by means of cutting-off the four corners thereof; in a mirror surface 72*a* of the orbiting scroll, is implanted the orbiting scroll lap 54 of a spiral wall shape; the wall of the orbiting scroll lap 54 faces the spiral wall of the stationary scroll lap 56; further, in a groove engraved on a tip ridge surface of the orbiting scroll lap 54, is installed a tip seal (not shown) of self-lubricating material. In addition, a bearing room 76 is provided at a rear surface 72*b* that is located at an opposite side of the mirror surface 72*a*; whereby, a ball bearing 74 is engaged into the bearing room 76.

In an upper part of the scroll casing 60, a suction mouth 78 is provided; in addition, a bearing room 82 into which a ball bearing 80 is engaged is provided to the scroll casing 60. On the other hand, within a motor casing 64, are provided:

a rotating shaft 86 comprising a rotor 84, a stator 92 comprising an electromagnet 88 and a coil 90, and cooling fans 94 that are attached to the rotor 84 and rotate together with the rotor 84.

The motor casing 64 is fastened to the scroll casing 60 by bolts (not shown); a first end side of the rotating shaft 86 is fitted into a ball bearing 96 and supported by the ball bearing 96 so that the shaft 86 can rotate; a second end side of the shaft 86 is fitted into the aforementioned ball bearing 74 and supported by the ball bearing 74 so that the shaft 86 can rotate.

At a second side end part 98 of the shaft 86, there is a cranked shaft part (a revolving/orbiting means) 100 the axis of which is eccentric against the axis of a main part of the shaft 86; the cranked shaft part 100 is fitted into a ball bearing 74 of the orbiting scroll 52 as well as is supported by the ball bearing 74.

Further, near first end side of the rotating shaft 86, a first counter-weight 102 is provided, while a second counter-weight 104 is provided at the second side end part 98 of the shaft 86; thanks to the counter-weights, an imbalance moment due to the cranked shaft part 100 is canceled; thus, a rotational balance (a lessened vibration) of the shaft 86 as a whole is secured; by the way, a term "unbalance" is sometimes used in stead of the term "imbalance" in the field of rotational machines, especially in the field of internal combustion engines.

An intermediate ring (an intermediate element) 110 of a polygon-shape is arranged so as to surround the orbiting scroll lap 54 of the orbiting scroll 52; the intermediate ring 110 is substantially of an octagonal shape that is obtained from a square shape by means of cutting-off the four corners thereof; the above octagonal shape is obtained in such a similar way as the aforementioned end plate 72 of the orbiting scroll 52 in FIG. 8 is obtained.

As shown in FIG. 8, an upper edge 52*a* of the orbiting scroll 52 is connected to an upper edge 110*a* of the intermediate ring 110 through a first plate spring 112*a*, while a lower edge 52*b* of the orbiting scroll 52 is connected to a lower edge 110*b* of the intermediate ring 110 through a first plate spring 112*b*; hence, the intermediate ring 110 is supported by the first plate springs against the drive-shaft 1, so as to be able to move in an above or below direction (a first direction) vertical to the axes of the shaft 86. In FIG. 8, the first plate springs 112*a* and 112*b* are of an oval track shape and two plate springs are provided per each edge; and, a line part of the track is used so that the first plate springs are fixed to the orbiting scroll and/or the intermediate spring.

In addition, a left edge 110*c* (not shown) of the intermediate ring 110 is connected to a left side edge 112*c* (not shown) of the stationary scroll 58 through a second plate spring 112*c*, while a right edge 110*d* of the stationary scroll 58 through a second plate spring 112*d*, hence, the intermediate ring 110 is supported by the second plate springs against the driven shaft 3, so as to be able to move in a left or right direction (a second direction) vertical to the first direction. The second plate springs 112*c* and 112*d* are of an oval track shape as the first plate springs are; two second plate springs are provided per each left or right edge of the intermediate ring 110; and, as in the case of the first plate springs, a line part of the track is used so that the second plate springs are fixed to the intermediate spring and/or the stationary scroll.

According to the scroll compressor 50, as shown in FIG. 7, the cranked shaft part 100 that is located eccentrically to the rotating shaft 86 revolves (orbits) around the axis thereof, when the shaft 86 is rotated by the drive motor 62; during this process, the orbiting scroll 52 can be rotated (can orbit) around an axis of the scroll compressor, without self-rotation, through the aforementioned functions of the first plate springs 112*a* and 112*b*, the intermediate ring 110, and the second plate springs 112*c* and 112*d*; on this occasion, a relative distance in an axial direction of the compressor between the orbiting scroll 52 and the mirror surface 58*a* of the scroll casing 60 is kept substantially constant.

Thanks to this substantially constant distance with which the orbiting scroll can be rotated, a sealing (gas-tightness) condition of a closed compression chamber 59 formed by the orbiting scroll lap 54 and the stationary scroll lap 56 is not spoiled; thus, the scroll compressor 50 can be realized with a simple configuration that enables an orbiting mechanism, as well as with sufficient functions as a scroll compressor.

As a working principle of a scroll compressor is explained with FIG. 11, a fluid suctioned through the suction mouth 78 of the scroll casing 60 is induced by the orbiting scroll lap 54, to the closed compression chamber 59 formed with the orbiting scroll lap 54 and the stationary scroll lap 56; the closed compression chamber 59 is directed toward the revolution center, while the volume of the chamber gradually reduces, that is, the induced gas is gradually pressurized; finally, a compressed gas is discharged through the discharge mouth 70 via the discharge port 68.

The first invention mode of the scroll compressor 50 as described thus far enables a self-rotating prevention mechanism different from that used in a conventional pin-crank mechanism or Oldham's coupling mechanism; namely, the self-rotating prevention mechanism of the present invention can be realized not by sliding parts or elements, but by means of the first plate springs 112*a* and 112*b*, the intermediate ring 110, and the second plate springs 112*c* and 112*d*; thus, the machines according to the invention can achieve enhanced wear durability without clearance-growth thanks to sliding-part-free configuration; moreover, the sliding part-free configuration makes it possible to do without lubrication oil or grease; still further, an easy maintenance management of the scroll compressor can be realized, while the sliding part-free configuration can reduce driving energy of the scroll compressor and yields less noises or less vibrations of the machines.

Hereafter, a second invention mode will now be described with reference to FIG. 9. A scroll compressor 200 of the second invention mode is of what is called "a mono-rotating type"; wherein, a drive scroll (a first scroll) and a driven scroll (a second scroll) are engaged in each other whereby both axes of the two kinds of scrolls are eccentric each other; and, a rotation movement is transmitted from the drive scroll to the driven scroll, when the drive scroll is rotated; in response to the relative revolving (orbiting) movement, a closed compression chamber formed by an engagement of the drive scroll lap and the driven scroll lap is directed toward the revolution center, while the volume of the chamber continuously reduces.

In FIG. 9, the same reference numerals as those for the elements of the above first invention mode to the scroll compressor 50 are used.

As in the explanation of the coupling mechanism 5, there is an eccentricity between the axis of the drive-shaft 1 and the driven shaft 3; hence, when a rotational movement is transmitted from the drive-shaft 1 to the driven shaft 3, a relative revolving (orbiting) movement starts between the drive-shaft 1 to the driven shaft 3, with a revolving radius equal to the eccentricity; therefore, a revolving mechanism can hold; that is, in the scroll compressor 50 as an example of the first mode, even if the stationary scroll 58 is not fixed to the scroll casing 60, the mentioned revolving (orbiting) mechanism can be realized.

In FIG. 9, a scroll compressor 200 comprises:

a drive scroll (a first scroll) 202 comprising an drive scroll lap (a first scroll lap) 204, a driven scroll (a second scroll) 208 comprising a driven scroll lap (the second scroll lap) 206, whereby the lap wall of the drive scroll lap (a first scroll lap) 204 faces that of the driven scroll lap (the second scroll lap) 206, while both laps are engaged into each other, a scroll casing 210 that covers the drive scroll 202 and the driven scroll 208, and a motor casing 64 that has a drive motor 62 within, whereby the motor 62 drives the drive scroll 202.

As in the case of the compressor shown in FIG. 7, an end plate 212 (in FIG. 9) of the drive scroll 202 (in FIG. 9) is substantially of an octagonal plate shape that is obtained from a square plate shape by means of cutting-off the four corners thereof; in a mirror surface 212*a* of the drive scroll, is implanted the drive scroll lap 204 of a spiral wall shape the wall of which faces the spiral wall of the driven scroll lap; whereby, the spiral starts from the center part of the end plate 212 toward an outer circumference thereof; further, in a groove engraved on a tip ridge surface of the drive scroll lap 204, is installed a tip seal (not shown) of self-lubricating material. In addition, with a spline joint, an end of a drive-shaft 214 is connected to a rear surface of the end plate 212 that is located at an opposite side of the mirror surface 212*a*; thus, a torque is transmitted from the drive-shaft 214 to the driven scroll 202.

As is the end plate 212, an end plate 222 of the driven scroll 208 is substantially of an octagonal plate shape that is obtained from a square plate shape by means of cutting-off the four corners thereof; in a mirror surface 222*a* of the driven scroll, is implanted the driven scroll lap 206 of a spiral wall shape the wall of which faces the spiral wall of the drive-scroll lap; whereby, the spiral starts from the center part of the end plate 222 toward an outer circumference thereof; further, in a groove engraved on a tip ridge surface of the driven scroll lap 206, is installed a tip seal (not shown) of self-lubricating material. Here, the spiral of the driven scroll lap 206 and that of the drive scroll lap 204 is substantially congruent; the former is engaged into the latter with a predetermined rotation angle so as to form a closed chamber.

In the center part of another side surface (a rear surface) of the driven scroll 208 (the end plate 222) the surface of which is located at an opposing side (counter-side) of the mirror surface 222*a*, is formed an driven shaft 224 together with the driven scroll, in one body; along a center axis of the driven shaft 224, a discharge hole 226 is bored; the hole 226 communicates with a discharge mouth 228. The driven shaft 224 is fitted into a ball bearing 230 and is supported thereby so as to be able to rotate freely in the scroll casing 210. In addition, there is an eccentricity δ between axes of the drive shaft 214 and the driven shaft 224.

In an upper part of the scroll casing 210, a suction mouth 231 is provided; in addition, a bearing room 82 into which a ball bearing 80 is engaged is provided to the scroll casing 210. Further, the motor casing 64 is fastened to the scroll casing 210 by bolts (not shown).

An intermediate ring (an intermediate element) 232 of a polygon-shape is arranged so as to surround the drive scroll lap 204 of the drive scroll 202 as well as the driven scroll lap 206 of the driven scroll 208; the intermediate ring 232 is substantially of an octagonal shape that is obtained from a square shape by means of cutting-off the four corners thereof; an upper edge of the end plate 212 (of the drive scroll 202) of the aforementioned (substantially) octagonal shape is connected to an upper edge of the intermediate ring 232 through a first plate spring 234*a*, while a lower edge of the end plate 212 (of the drive scroll 202) is connected to a lower edge of the intermediate ring 232 through a first plate spring 234*b*; hence, the intermediate ring 232 is supported by the first plate springs against the drive scroll 202, so as to be able to move in an above or below direction (a first direction) vertical to an axis of the drive-shaft 214; whereby, the first plate springs 234*a* and 234*b* are of an oval track shape and two plate springs are provided per each edge.

In addition, left/right side edges of the intermediate ring 232 are connected to left/right side edges of the end plate 222 (of the driven scroll 208) of substantially octagonal shape, respectively, through a second plate springs 234*c* and 234*d*; hence, the intermediate ring 232 is supported by the second plate springs against the driven scroll 208, so as to be able to move in a left or right direction (a second direction) vertical to the first direction; whereby, as in the case of the first plate springs 234*a* and 234*b*, the second plate springs 234*c* and 234*d* are of an oval track shape and two plate springs are provided per each edge.

According to the scroll compressor 200, as shown in FIG. 9, an axis of the drive-shaft 214 and an axis of the driven shaft 224 are arranged with the eccentricity δ; hence, thanks to a parallel translation mechanism that is realized with the intermediate ring 232, the first plate springs 234*a* and 234*b*, and the second plate springs 234*c* and 234*d*, a rotational movement of the drive scroll is transmitted to the driven scroll, while a relative revolving (orbiting) movement between the drive scroll and the driven scroll is realized.

In response to the relative revolving (orbiting) movement, a closed compression chamber formed by an engagement of the drive scroll lap 204 and the driven scroll lap 206 is directed toward the revolution center, while the volume of the chamber gradually (continuously) reduces; a fluid suctioned through the suction mouth 231 of the scroll casing 210 is induced, by the drive scroll lap 204, to the closed compression chamber formed by the drive scroll lap 204 and the driven scroll lap 206; the closed compression chamber 59 is directed toward the revolution center, while the volume of the chamber gradually reduces, that is, the induced fluid is gradually pressurized; finally, a compressed fluid is discharged through the discharge mouth 228 via the discharge port 226.

During the above-mentioned revolving (orbiting) movement that is realized with the first plate springs 234*a* and 234*b*, the intermediate ring 232, and the second plate springs 234*c* and 234*d*, a relative distance in an axial direction of the compressor between the mirror surface 212*a* of the drive scroll 202 and the mirror surface 222*a* of the driven scroll 208 is kept substantially constant; thus, a sealing (gas-tightness) condition of a closed compression chamber formed by the drive scroll lap 204 and the driven scroll lap 206 is not spoiled; namely, the scroll compressor 200 can be realized with a simple configuration that enables an revolving (orbiting) mechanism, as well as with sufficient functions as a scroll compressor.

The scroll compressor 200 can transmit a rotational movement from the drive-shaft to the driven shaft as well as the compressor 200 can realize a relative revolving (orbiting) movement between the drive scroll and the driven scroll, without a conventional mechanism such as a crank-mechanism that is provided between the drive scroll and the driven scroll; further, the scroll compressor 200 can not use a sliding parts thanks to a set of elements comprising the first plate springs 234*a* and 234*b*, the intermediate ring 232, and the second plate springs 234*c* and 234*d*; thus, the scroll compressor 200 according to the invention can achieve enhanced wear durability without clearance-growth because of sliding-part-free configuration; moreover, the sliding part-free configuration makes it possible to do without lubrication oil or grease; still further, an easy maintenance management of the scroll compressor can be realized, while the sliding part-free configuration can reduce driving energy of the scroll compressor and yields less noises or less vibrations of the machines.

In the following, another (a third) invention mode is explained with reference to FIG. 10.

A scroll compressor 300 of the third mode is different from those of the first mode and the second mode, in arrangement of an intermediate element.

In the first mode, the intermediate ring 110 of a polygon-shape is placed so as to surround the orbiting scroll lap 54 of the orbiting scroll 52 as well as the stationary scroll lap 56 of the stationary scroll 58, whereas, in the second mode, the intermediate ring 232 of a polygon-shape is placed so as to surround the driven scroll lap 206 as well as the drive scroll lap 204. On the other hand, in the third mode, an intermediate ring 310 is placed between a rear surface of an orbiting scroll 352 and a scroll casing 360 that forms a stationary scroll 358.

Except the parts related to the above-mentioned parts such as the orbiting scroll, the stationary scroll, the intermediate ring, and scroll casing, most of the parts in the third mode are common to those in the first mode; hence, a same numeral is assigned to such a common part in both modes (i.e. in FIG. 7 and in FIG. 10).

A bearing room 76 is provided at a rear surface 372*b* that is located at an opposite side of the mirror surface 372*a*; outside the outer periphery of the bearing room 76, the intermediate ring (an intermediate element) 310 of a polygon-shape is placed so as to surround the room 76; hereupon, as shown in the perspective FIG. 8 that is used for the explanation of the first mode, the contour of the intermediate ring 310 is substantially of an octagonal plate shape that is obtained from a square plate shape by means of cutting-off the four corners thereof.

An upper edge of the end plate 372 (of the orbiting scroll 352) of a substantially-octagonal shape is connected to an upper edge of the intermediate ring 310 through a first plate spring 312*a*, while a lower edge of the end plate 372 (of the orbiting scroll 352) is connected to a lower edge of the intermediate ring 310 through a first plate spring 312*b*; hence, the intermediate ring 310 is supported by the first plate springs 312*a* and 312*b* against the orbiting scroll 352, so as to be able to move in an above or below direction (a first direction) vertical to an axis of a rotating shaft 86.

Here, the first plate springs 312*a* and 312*b* are of an oval track shape and two plate springs are provided per each edge; further, a part of a straight segment of the track is fixed to the intermediate ring or the end plate (of the orbiting scroll 352).

Further, left/right side edges of the intermediate ring 310 are connected to left/right side edges of the scroll casing 360 that forms the stationary scroll 358, through a second plate spring 312*c*, and a second plate spring 312*d* (not shown as the spring 312*d* is located at a viewer side of the figure-sheet), respectively; thus, the intermediate ring 310 is supported by the second plate springs against the stationary scroll 358, so as to be able to move in a left or right direction (a second direction) vertical to the first direction; whereby, as in the case of the first plate springs 312*a* and 312*b*, the second plate springs 312*c* and 312*d* are of an oval track shape and two plate springs are provided per each edge; further, apart of a straight segment of the track is fixed to the intermediate ring or the scroll casing.

According to the scroll compressor 300, as shown in FIG. 10, a cranked shaft part 100 that is located eccentrically to the rotating shaft 86 revolves (orbits) around the axis thereof, when the shaft 86 is rotated by a drive motor 62; during this process, the orbiting scroll 352 can be rotated (can orbit) around an axis of the scroll compressor, without self-rotation, through the aforementioned functions of the first plate springs 312*a* and 312*b*, the intermediate ring 310, and the second plate springs 312*c* and 312*d* (not shown); thus, is secured a function of a scroll compressor that an induced air (gas/fluid) in a closed compression chamber 359 that an orbiting scroll lap 354 and a stationary scroll lap 356 form is gradually compressed, while being sent toward a central part of the scrolls.

The above-described function in the third mode is essentially equivalent to that in the first mode; on the other hand, this third mode makes it possible that the configuration elements such as the intermediate ring 310, the first plate springs 312*a*/312*b*, and the second plate springs 312*c*/312*d* need to be placed not outside the outer periphery of the orbiting scroll lap 354 and the stationary scroll lap 356, but on a side of the rear surface 372*b* that is located opposite to the mirror surface 372*a* of the end plate 372 in the orbiting scroll 352; therefore, the intermediate ring can be provided independently of the heights (space) as to the orbiting scroll lap 354 and the stationary scroll lap 356.

As a result, this invention mode realizes a compact scroll compressor even when there is little room outside the outer periphery of the orbiting scroll lap 354 and the stationary scroll lap 356 as the intermediate ring can be installed on a side of the rear surface 372*b* of the end plate 372. Thus, the invention enhances the degree of freedom as to the scroll compressor design.

INDUSTRIAL APPLICABILITY

The present invention provides a scroll fluid machine that realizes a relative revolving (orbiting) movement between a drive scroll and the driven scroll without a sliding element configuration such as used in conventional Oldham's coupling mechanisms and/or pin-crank mechanisms; thus, the invention discloses a useful and contributive technology.

This application is based on, and claims priority to, Japanese Patent Application No: 2007-95579, filed on Mar. 30, 2007. The disclosure of the priority application, in its entirety, including the drawings, claims, and the specification thereof, is incorporated herein by reference.

What is claimed is:

1. A scroll fluid machine comprising:

a first scroll having a first scroll lap;

a second scroll having a second scroll lap that is engaged with the first scroll lap and forms a closed compression chamber together with the first scroll lap;

an intermediate element that transmits torque between the first scroll and the second scroll;

a first plate spring element that connects the intermediate element to the first scroll and supports the intermediate element to enable the intermediate element to move in a first direction orthogonal to a rotation axis of the machine; and a second plate spring element that connects the intermediate element to the second scroll and supports the intermediate element to enable the intermediate element to move in a second direction orthogonal to the rotation axis of the machine as well as orthogonal to the first direction, wherein a revolving axis of the first scroll and a rotation axis of the second scroll are placed with an eccentricity so that the first scroll revolves relatively around the second scroll.

2. The scroll fluid machine according to claim 1, wherein the intermediate element has a ring-shape and is arranged to surround the first scroll lap of the first scroll and the second scroll lap of the second scroll.

3. The scroll fluid machine according to claim 1, wherein the second scroll is fixed to a casing of the machine, while the first scroll orbits around the rotation axis of the second scroll with an orbiting radius equal to the eccentricity.

4. The scroll fluid machine according to claim 1, wherein:

the second scroll is a driven scroll that rotates around the rotation axis of the second scroll and is supported by a casing of the machine, while the second scroll is rotated by the first scroll, the axis of which is eccentrically positioned relative to the axis of the second scroll with the eccentricity, and a relative orbiting movement is performed between the first scroll and the second scroll.

5. The scroll fluid machine according to claim 1, wherein:

the intermediate element has a polygon-shape or a ring-shape, a pair of the first plate spring elements are fitted to one opposite-side edges of the polygon-shaped or ring-shaped intermediate element, and a pair of the second plate spring elements are fitted to another opposite-side edges of the polygon-shaped or ring-shaped intermediate element, the one opposite-side edges coincide with the another opposite-side edges when the one opposite-side edges or the another opposite-side edges are rotationally moved by 90 degrees in a plane orthogonal to the axis of the machine.

6. The scroll fluid machine according to claim 5, wherein a plurality of the first plate spring elements and a plurality of the second plate spring elements are placed on each edge of the intermediate element.

7. The scroll fluid machine according to claim 1, wherein:

the first plate spring element and the second plate spring element each have an oval track shape, a part of a line part of the oval track-shaped first plate spring element is fitted to the intermediate element, while a part of another line part of the oval track first plate spring element is fitted to the first scroll, and a part of a line part of the oval track-shaped second plate spring element is fitted to the intermediate element, while a part of another line part of the oval track-shaped second plate spring element is fitted to the second scroll.

8. The scroll fluid machine according to claim 7, wherein a plurality of the first plate spring elements and a plurality of the second plate spring elements are placed on each edge of the intermediate element.

* * * * *